US008695233B2

(12) United States Patent
Youngs

(10) Patent No.: US 8,695,233 B2
(45) Date of Patent: Apr. 15, 2014

(54) COLD WEATHER BOOT

(75) Inventor: Bryan Youngs, Portland, OR (US)

(73) Assignee: Keen, Inc., Portland, OR (US)

( * ) Notice: Subject to any disclaimer, the term of this patent is extended or adjusted under 35 U.S.C. 154(b) by 579 days.

(21) Appl. No.: 13/019,168

(22) Filed: Feb. 1, 2011

(65) Prior Publication Data

US 2012/0192457 A1 Aug. 2, 2012

(51) Int. Cl.
*A43C 11/00* (2006.01)

(52) U.S. Cl.
USPC ..... 36/50.1; 36/51; 36/109

(58) Field of Classification Search
USPC ..... 36/109, 45, 51, 50.1
See application file for complete search history.

(56) References Cited

U.S. PATENT DOCUMENTS

| | | | | | |
|---|---|---|---|---|---|
| 433,154 | A * | 7/1890 | Turner | 36/45 |
| 495,450 | A * | 4/1893 | Braunwarth | 36/4 |
| 1,061,740 | A * | 5/1913 | Gehant | 36/109 |
| 1,978,140 | A * | 10/1934 | Miller | 36/45 |
| 2,540,531 | A * | 2/1951 | Johnston | 36/4 |
| 3,749,091 | A | 7/1973 | Basa | |
| D361,426 | S * | 8/1995 | Baker | D2/970 |
| 5,678,325 | A * | 10/1997 | Davidowitz et al. | 36/11 |
| 6,237,252 | B1 * | 5/2001 | Cook | 36/50.1 |
| 6,772,540 | B2 | 8/2004 | Delgorgue et al. | |
| 6,877,257 | B2 | 4/2005 | Delgorgue et al. | |
| 6,944,971 | B2 | 9/2005 | Delgorgue et al. | |
| 7,530,183 | B2 * | 5/2009 | Munns | 36/131 |
| 7,958,655 | B2 * | 6/2011 | Munns | 36/131 |
| 2004/0205982 | A1 * | 10/2004 | Challe | 36/55 |
| 2009/0090023 | A1 | 4/2009 | Rackiewicz et al. | |
| 2010/0275465 | A1 * | 11/2010 | Reilly et al. | 36/136 |

OTHER PUBLICATIONS

Reaume, Daniel J., "Making Non-Obviousness More Obvious after KSR v. Teleflex: The Technology-Landscape Approach," <http://www.foley.com/files/tbl_s31Publications/FileUpload137/5618/Reaume.pdf>, 29 pages.

* cited by examiner

*Primary Examiner* — Marie Patterson
(74) *Attorney, Agent, or Firm* — Alleman Hall McCoy Russell & Tuttle LLP

(57) ABSTRACT

A boot for sealing out environmental elements is disclosed. In one example, the boot includes a drawstring seal between the boot and a leg of wearer. The boot can limit the intrusion of environmental elements to the interior of the boot at least during some conditions.

17 Claims, 5 Drawing Sheets

COLD WEATHER BOOT

BACKGROUND/SUMMARY

Boots may be constructed for a variety of purposes. For example, in U.S. Pat. No. 3,749,091, a boot is provided to facilitate delivery of a liquid medication to a foot of a wearer of the boot. The boot includes a sole and an upper that is coupled to the sole. The upper includes a tubular passageway housing a drawstring that is configured to hold a liquid within the boot when the drawstring is drawn taught. The tubular passageway and the drawstring compress the relatively flexible boot against the contained ankle of the wearer to seal liquid within the boot.

However, since the tubular passageway is designed to compress the boot against the ankle of the wearer, the visual appearance of the boot can be degraded when the drawstring is tightened. Further, an upper end of the boot is attached to the boot upper near the drawstring such that the upper end may also distort when the drawstring is tightened. As a result, the top end of the upper end may flex in an outward direction when the drawstring is tightened so that the upper end of the boot tends to capture and hold debris external to the boot. Thus, the drawstring arrangement may tend hold liquid within the boot; however, it may also degrade the capability of the boot to seal out external elements when tightening the boot causes the upper end to distort.

The inventors herein have recognized the above-mentioned disadvantages and have developed a boot that seals the inside of the boot from external elements without having to distort the appearance of the boot. In particular, the inventors have developed a boot comprising: a sole; an upper coupled to the sole including a top portion having an interior wall, the top portion further having an opening for receiving a leg of a wearer; and a sleeve coupled to the interior wall of the top portion of the upper, the sleeve projecting inwardly into the opening from the interior wall of the top portion of the upper forming a flexible seal against the leg, the sleeve being more flexible than the top portion of the upper.

By constructing a boot with a sleeve coupled to an interior wall of a top portion of a boot upper, it is possible to tighten the sleeve and seal the boot against the wearer's leg without distorting or disturbing the external appearance or styling of the boot. For example, the sleeve can be configured as a flexible portion of the boot while the top portion of the upper is configured as a more rigid portion of the boot. In this way, the sleeve can be used to seal the boot from elements external of the boot while the upper maintains its shape and comfort.

The present description may provide several advantages. For example, the described boot can present a stylish appearance whether or not the boot is sealed against the wearer. Further, the circumference of the sleeve can be varied to conform to different leg sizes without having to distort the outer appearance of the boot. Further still, reinforcing material supporting the top portion of the upper can also provide vertical support to the sleeve so that the sleeve is oriented in a vertical manner to keep external elements from entering the boot.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
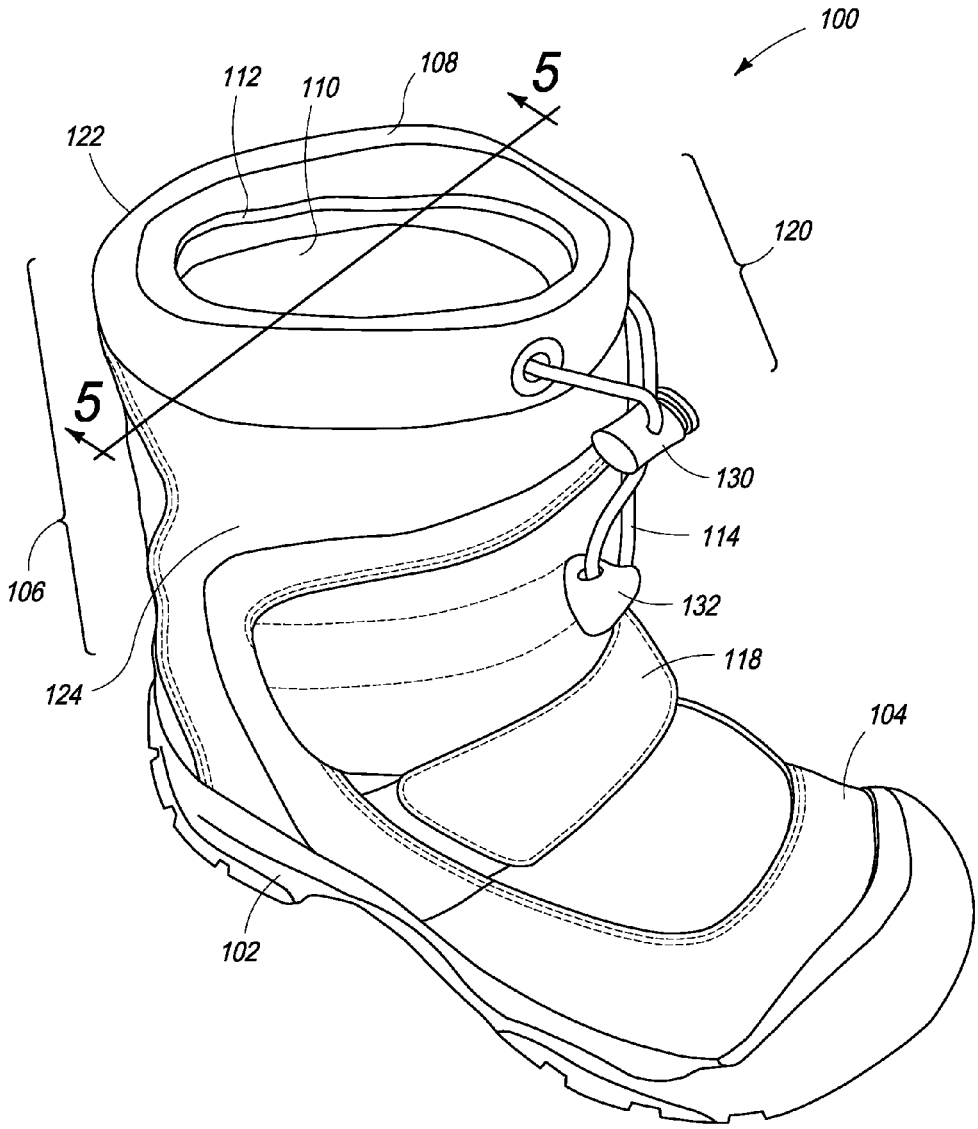
FIG. 1 shows a perspective view of a boot.
Figure 2:
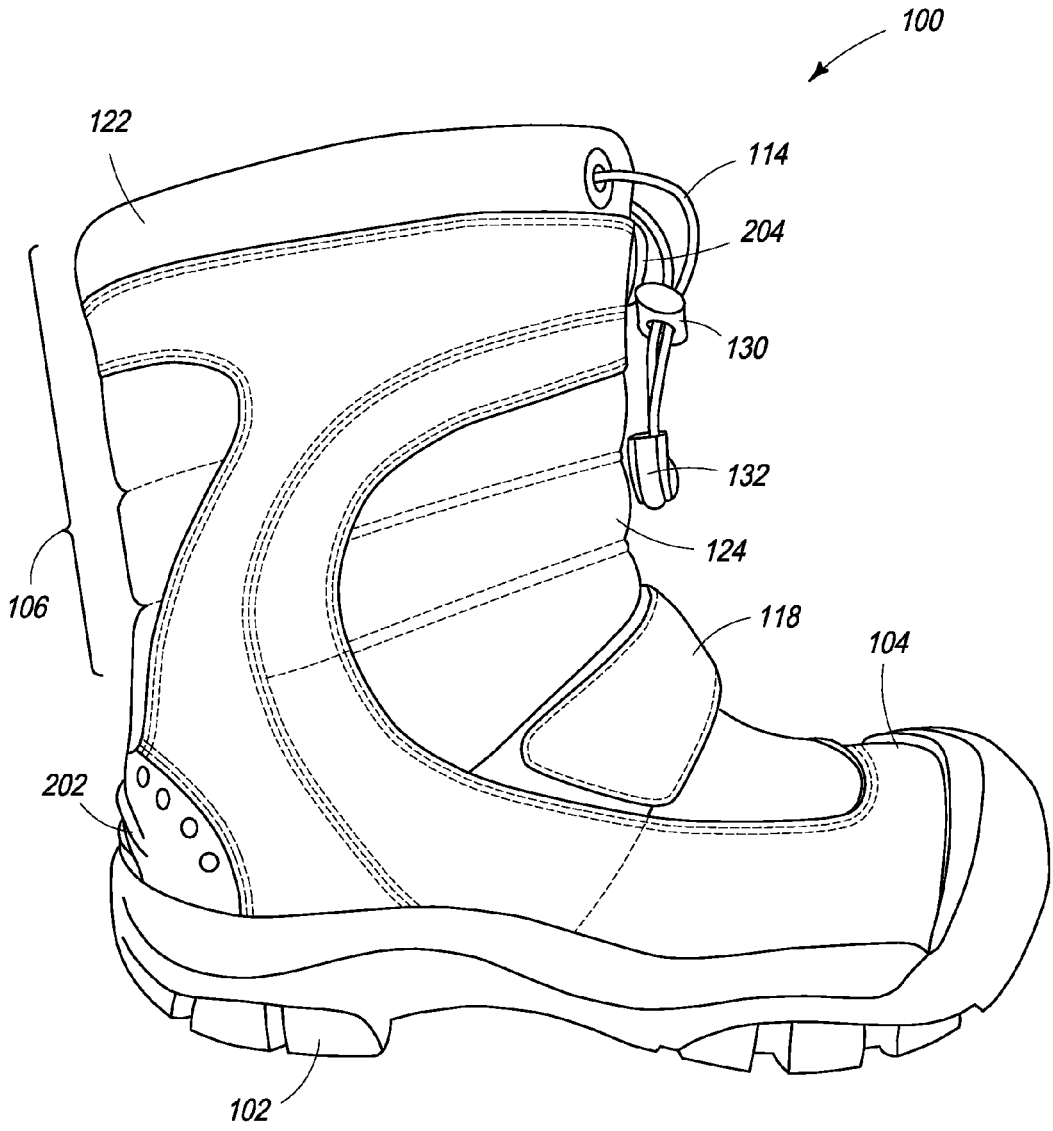
FIG. 2 shows a side view of a boot.
Figure 3:
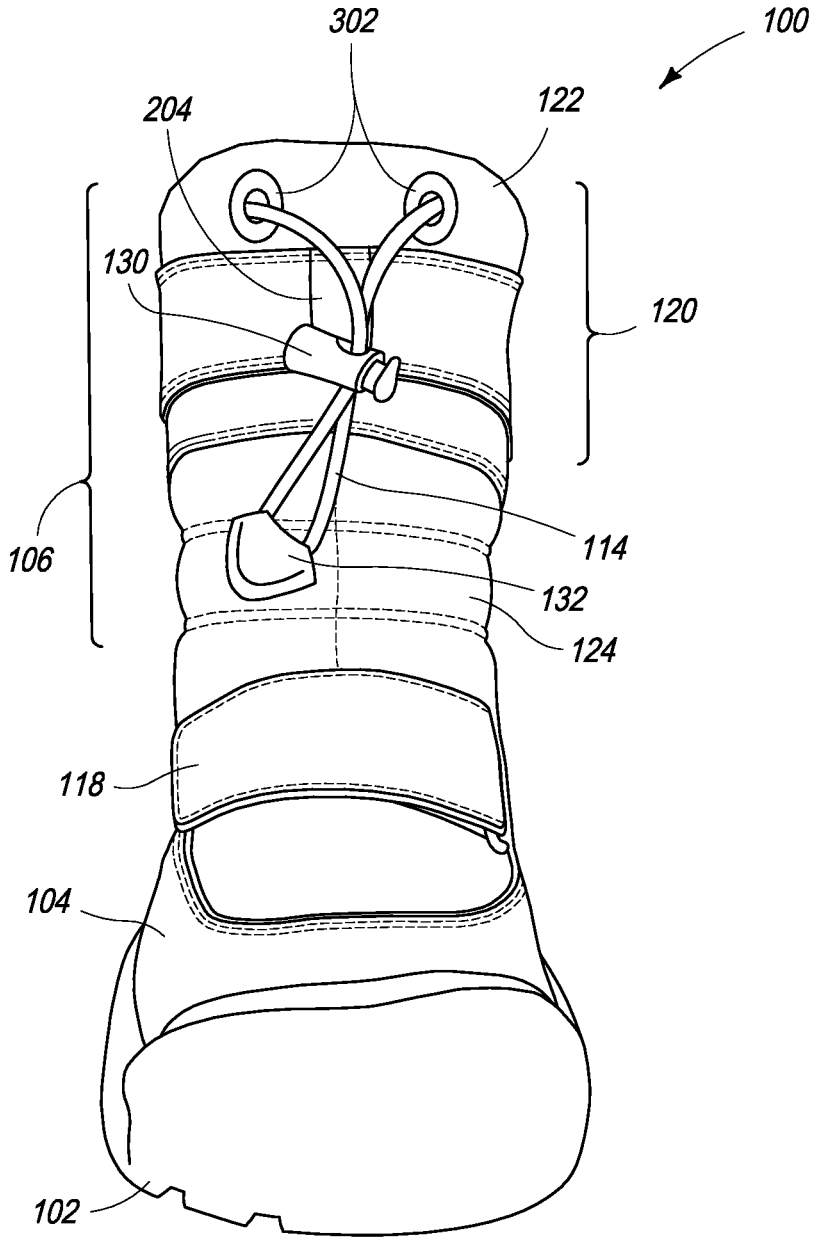
FIG. 3 shows a front view of a boot.
Figure 4:
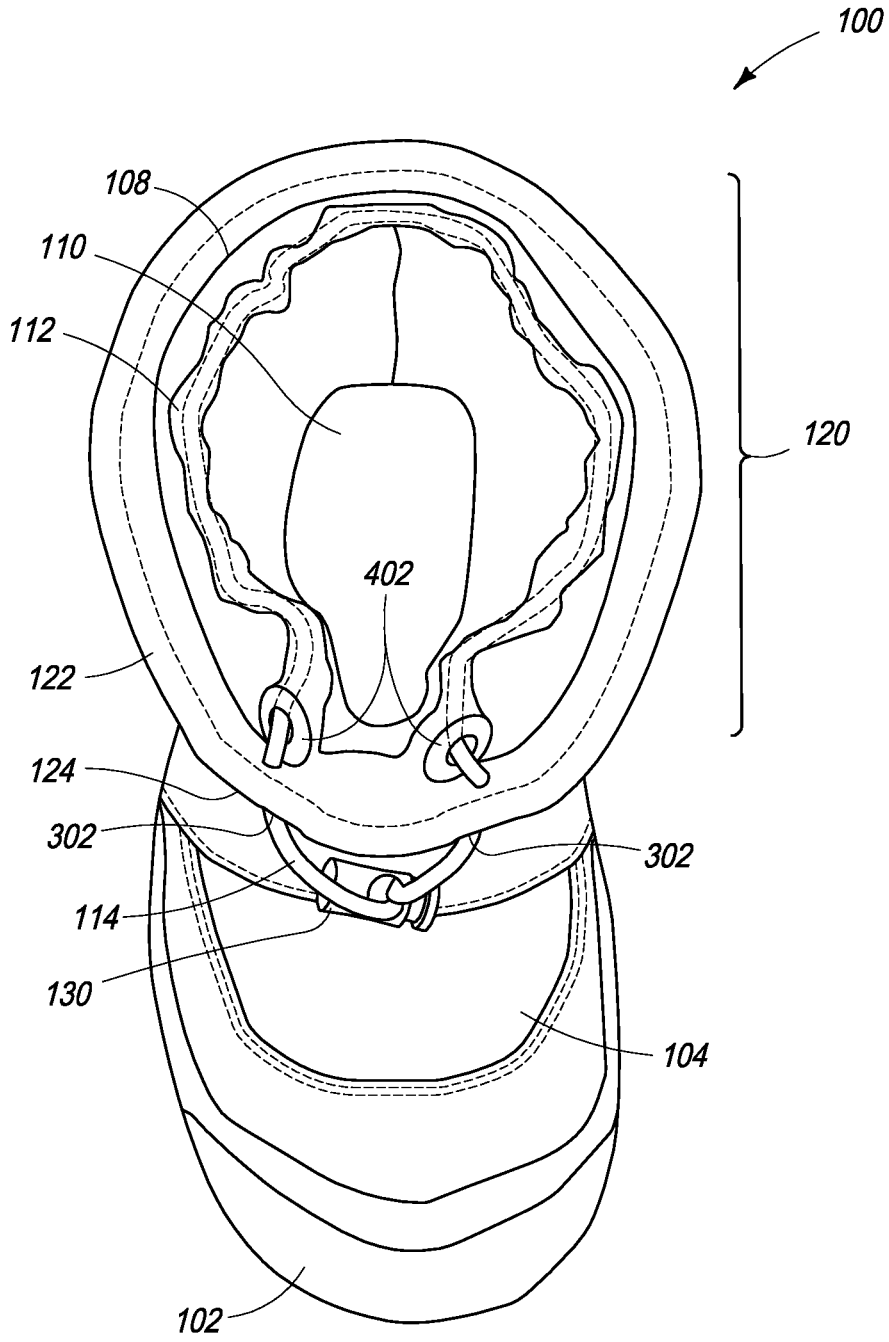
FIG. 4 shows a plan view of a boot.
Figure 5:
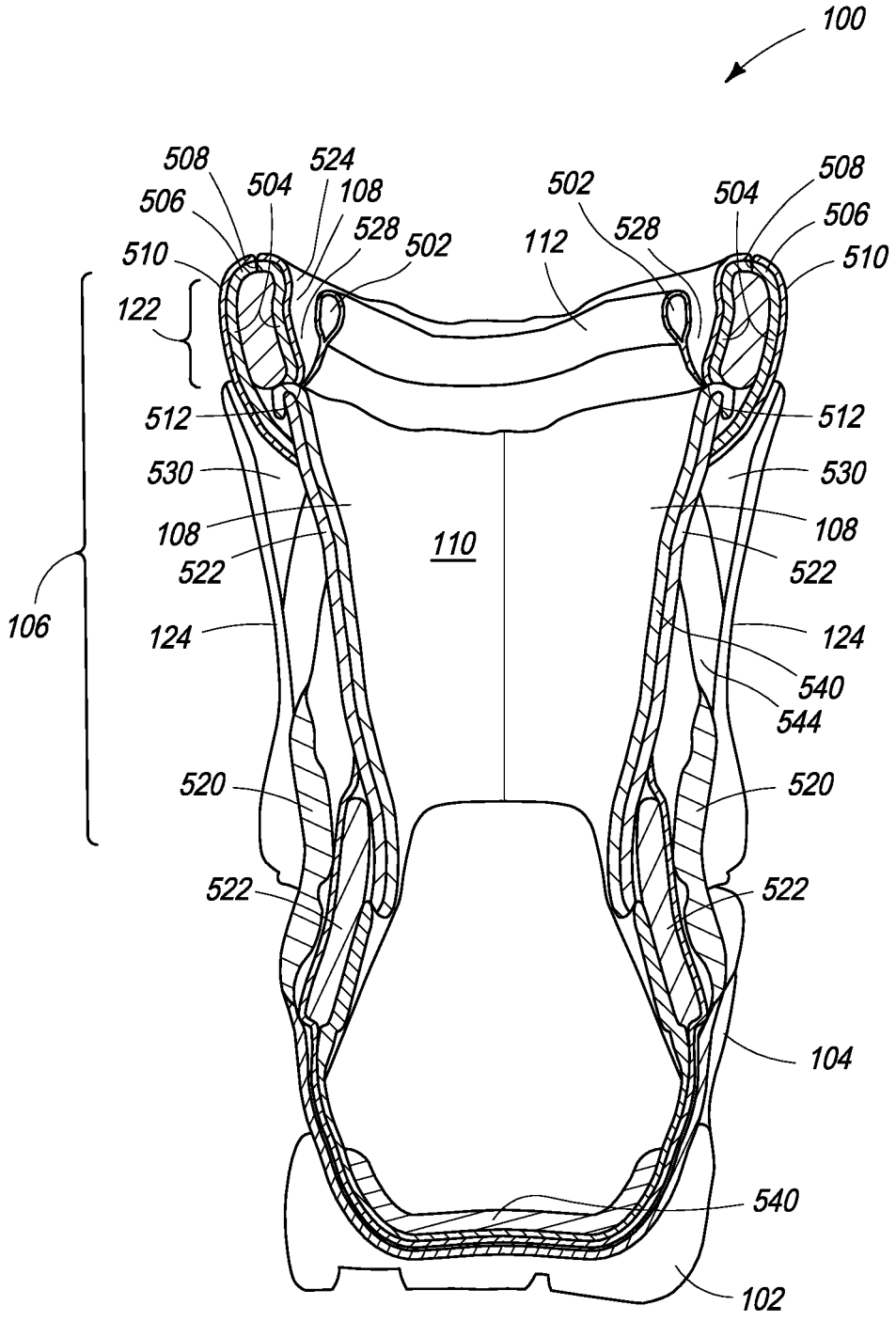
FIG. 5 shows a cut-away view of a boot.

The present description is related to a boot that can insulate the wearer from external environmental elements. A perspective view of the boot including a sleeve that can seal the boot to a wearer's leg is shown in FIG. 1. The boot includes a cinching system and a binding strap as shown in FIG. 2. The cinching system may include a sleeve that projects inwardly to the interior of the boot and extends around an interior wall of the boot as is shown in FIG. 3. The boot may be constructed of several layers of materials as shown in FIGS. 4-5. The figures are drawn approximately to scale, although the configuration described herein may be used for a variety of shoe sizes and relative shapes. For example, while the sleeved configuration of the boot may be particularly advantageous for children's boots (where it can otherwise be particularly difficult to obtain a tight seal to keep snow out), it of course may be applied to adult boots.

It will be appreciated that common components and elements described in FIGS. 1-5 carry identical numerical identifiers throughout the description and figures. The description of an element shown in a one figure applies equally to the same element shown in another figure.

Referring to FIG. 1, boot 100 is comprised of sole 102 that may be constructed of natural or man-made material. In one example, sole 102 is made of synthetic rubber. Sole 102 may rap around at least a portion of a boot wearer's toe as shown in FIG. 1. Alternatively, sole 102 may end at a vertical height with respect to the bottom of boot 100 that is lower than a height of a wearer's foot when the wearer's foot is in the boot. Sole 102 may be comprised of a single type and color rubber or of a combination of different types and/or colors of rubber.

Upper 104 is glued to sole 102, although in other examples, upper 104 may be coupled to sole 102 via a sewn attachment or another known way of attachment. Upper 104 is shown with binding strap 118 and a top portion 106. In one example, binding strap 118 may be a Velcro binding strap that permits rapid and repeated binding of boot 100 to a wearer's foot. Upper 104, binding strap 118, and top portion 106 may be comprised of natural and/or man-made materials. In one example, upper 104, binding strap 118, and top portion 106 may be comprised of a combination of leather and woven man-made material. Further, upper 104, binding strap 118, and top portion 106 may be chemically treated to resist penetration of water into the interior of boot 100.

Top portion 106 is shown with opening 110 for insertion of a wearer's foot and cinching system 120 for sealing the interior of boot 100 from external environmental elements, such as snow. Top portion 106 is also shown with interior wall 108 and exterior wall 124. Cinching system 120 is comprised of collar 122, sleeve 112, and drawstring 114. However, in other examples, drawstring 114 may be replaced with a different type of flexible tightening device such as a wire or strap and collar 122 may be a continuous part of top portion 106. Sleeve 112 is coupled to and extends around at least a portion of interior wall 108 of top portion 106. In the present example, sleeve 112 extends around the entire interior circumference of top portion 106. Cinching system 120 is also shown with tensioning device 130 for securing a position of drawstring 114. The ends of drawstring 114 terminate in retainer 132 which keeps the ends of drawstring 114 together and from separating. In one example, retainer 132 is a molded plastic retainer.

Cinching system 120 and top portion 106 permit a wearer's leg to move relative to the upper 104 and top portion 106 while maintaining a seal between boot 100 and the wearer. Further, at least a portion of sleeve 112 is flexible with respect to interior wall 108 so that sleeve can follow movement of a wearer's leg while maintain a seal between the wearer and the boot.

FIG. 1 also shows a line that identifies a cutting plane for the cut-away view shown in FIG. 5. The cutting plane extends from the top of boot 100 and thorough sole 102 at a location near heal of boot 100.

Referring now to FIG. 2, a side view of boot 100 is shown. Sole 102 is shown extending the length of boot 102. Upper 104 is shown with heal insert 202 which is sandwiched between upper 104 and sole 102. Heal insert 202 wraps around the heal portion of boot 100 and may reduces degradation of upper 104 when boot 100 is removed from a wearer's foot. In particular, heal insert 202 provides a surface to exert force upon during removal of boot 100 from a wearer's foot. Binding strap 118 is shown in a closed position where binding strap 118 can draw boot 100 to a wearer's foot after the boot is slipped on a wearer. Drawstring 114 and tensioning device 130 are shown extending from front of boot 100. Tensioning device 130 is also shown coupled to boot 100 via hoop 204 which is secured to exterior wall 124 of top portion 106. The ends of drawstring 114 terminate at retainer 132.

FIG. 2 shows that drawstring 114 is hidden within boot 100 except at the front of boot 100 where drawstring 114 exits boot for tightening by the wearer. Further, boot 100 stands in an upright position with no signs that drawstring 114 extends around the interior of boot 100. In particular, the top portion 106 of upper 104 extends in a vertical direction without the appearance of a drawstring channel for drawstring 114. As such, it is possible for boot 100 to retain a stylish appearance.

Referring now to FIG. 3, a front view of boot 100 is shown. The toe portion of sole 102 is shown extending across the entire front of boot 100. Binding strap 118 is also shown reaching from one side of boot 100 to the other side of boot 100. Thus, binding strap 118 is configured to apply force to a front portion of the wearer's foot. The top portion 106 of upper 104 is shown with drawstring 114 passing through tensioning device 130 before entering a set of two exterior eyelets 302. Further, drawstring retaining hoop 204 is attached at exterior wall 124 and positioned in the center of the front of boot 100 below and between exterior eyelets 302. Exterior eyelets 302 are stationary with respect to top portion 106 so that when drawstring 114 is drawn taught and held in position via tensioning device 130, the position of drawstring 114 relative to boot 100 is at least partially maintained via eyelets 302. Exterior eyelets 302 are shown positioned at the front portion of collar 122.

Referring now to FIG. 4, a plan view of a boot is shown. A front portion of sole 102 is shown relative to opening 110. Upper 104 extends from the front of boot 100 to the rear of boot 100. FIG. 4 also shows a perspective for describing how cinching system 120 operates as part of boot 100.

One end of drawstring 114 passes through exterior wall 124 and into one eyelet of a set of two exterior eyelets 302. One of two exterior eyelets 302 allows drawstring 114 to pass through interior wall 108 of boot 100 to enter an interior portion of boot 100. After passing through interior wall 108, drawstring 114 enters one eyelet of a set of two interior eyelets 402. Interior eyelets 402 are coupled to sleeve 112 and permit drawstring 114 to enter a tubular duct within sleeve 112. Drawstring 114 traverses around an interior circumference of opening 110 via a tubular passage in sleeve 112 before draw string 114 exits sleeve 112 via the other eyelet of the two interior eyelets 402. Drawstring 114 proceeds from one of the two interior eyelets 402 to one of the two exterior eyelets 302. Drawstring 114 enters and exits one of the two exterior eyelets to exit boot 100. Both ends of drawstring 114 enter tensioning device 130 and terminate at retainer (not shown).

Thus, it can be seen from FIG. 4 that a first set of interior eyelets 402 are positioned in sleeve 112 directly behind exterior eyelets 302 of top portion 106 of upper 104. Interior eyelets 402 are positioned such that when drawstring 114 is drawn taught, holes of interior eyelets 402 and holes of exterior eyelets 302 align through a common centerline that extends through the internal and external eyelets. Further, a sealing portion of sleeve 112 is elevated by the configuration of interior eyelets 402, exterior eyelets 302, sleeve 112, and top portion 106 when drawstring 114 is drawn taught. For example, exterior eyelets 302 are positioned at a top of sleeve 112 above (e.g., in a vertical direction with respect to the bottom of the boot) a seam between sleeve 112 and interior wall 108 that couples sleeve 112 to interior wall 108. Since drawstring 114 passes through exterior eyelets 302 to exit boot 100, pulling drawstring 114 through to the exterior eyelets 302 causes the sealing portion of sleeve to extend in a vertical direction away from a bottom of boot 100. In particular, the interior eyelets 402 are positioned in sleeve 112 near a portion of sleeve 112 that seals sleeve 112 to a wearer's leg and away from the seam coupling sleeve 112 to interior wall 108. In this way, pulling drawstring 114 out the front of boot 100 causes the portion of sleeve 112 that seals to a wearer's leg to elevate in a vertical direction away from the bottom of boot 100. Further, since drawstring 114 is retained within sleeve 112 via a tubular channel, tightening drawstring 114 can cause the entire inner circumference of sleeve 112 that seals boot 100 against a wearer's leg to elevate in a vertical direction and decreases in diameter.

Referring now to FIG. 5, a cut-away view of boot 100 is shown. Sole 102 is shown at a location near the heal of boot 100, and the cut-away view reveals components of boot upper 104 that are positioned behind exterior eyelets 302 shown in FIG. 3. A heal pad 540 is glued on top of portions of exterior wall 124 and interior wall 108 that are glued to sole 102. Top portion 106 of upper 104 includes an outer upper 544 and an inner upper 540. In the example of FIG. 5, the outer upper 544 is comprised of at least part of exterior wall 124 and outer upper shape retaining foam 520. The inner upper 540 is comprised of at least part of interior wall 108 and inner upper shape retaining foam 522. In one example, the exterior wall 124 may be comprised of a combination of alternating panels of man-made and natural materials. In other examples, exterior wall 124 may be comprised of a single man-made or natural material. It can also be seen from FIG. 5 that the shape retaining foam used to support and reinforce inner upper 540 and outer upper 544 may be comprised of various thicknesses and heights of shape retaining foam or other suitable material. Further, the shape retaining foam may be sewn and/or glued to the interior wall 108 and exterior wall 124.

Seam 530 is shown between inner upper 540 and outer upper 544. Seam 530 may be held together via glue and/or thread. In the present example, seam 530 retains and conceals ends of collar 122. In the example of FIG. 5, an exterior portion of collar 122 is made of man-made material 510. Further, material 510 may be part of exterior wall 124. Material 510 is retained within seam 530 at a bottom end. Material 510 is retained at seam 506 at a top end. Thus, material 510 wraps around an exterior portion of collar 122 to seam 506. In an alternative example, material 510 may wrap around the exterior to the interior portion of collar 122 forming part of interior wall 108.

At a top of seam 530, an interior portion of collar 122 is made of material 524. In one example, material 510 and material 524 are the same material. Thus, an exterior layer of at least a portion of the interior and exterior of the boot may be constructed of the same type of material. Material 524, interior wall 108 and sleeve 112 are sewn and/or glued together at seam 512. In this way, a channel 528 may be formed between sleeve 112 and collar 122. A valley of channel 528 may be oriented toward a bottom of boot 100 when drawstring 114 of FIG. 1 is drawn taught. In some examples, material 524 of collar 122 may be considered part of interior wall 108.

Material 510 and material 524 of collar 122 are supported and reinforced by felt padding 504 and shape retaining foam 508. Shape retaining foam 508 reduces distortion of collar 112 when drawstring 114 of FIG. 1 is tightened. In one example, collar 122 and top portion 106 of upper 104 include shape retaining foam to reinforce and reduce distortion of boot 100 when drawstring 114 of FIG. 1 is tightened. Collar 112 and top portion 106 of upper 104 may include more shape retaining foam than sleeve 112 so that sleeve distorts before collar and top portion 106 of upper 104. In one example, sleeve contains no shape retaining foam or reinforcing material.

It can be seen from FIG. 5 that sleeve 112 projects inwardly from the interior wall 108 to opening 110 where the wearer's leg may be inserted. The interior most end of sleeve 112 is also oriented in an upward vertical direction relative to the bottom of the boot and the seam 512 where sleeve 112 is coupled to interior wall 108. This arrangement can direct external debris away from the wearer's leg and the interior portion of boot 100. The sleeve 112 is also configured to be more flexible than top portion 106 of upper 104 so that the sleeve 112 distorts to form a seal against the wearer's leg rather than the top portion 106 of upper 104.

FIG. 5 also reveals tubular passage 502 that is present around the length of sleeve 112. Drawstring 114 of FIG. 1 passes through tubular passage 502 as described above and acts to apply pressure between a boot wearer's leg and sleeve 112. Further, the sleeve allows motion between the wearer's leg relative to the interior of the boot without losing a seal between the leg and the boot. In the present example, tubular passage 502 is fabricated by rolling around one end of sleeve 112 and retaining the end to another portion of sleeve 112.

As will be appreciated, FIGS. 1-5 illustrate one example of a boot where the top portion of the upper includes an internal, flexible, sleeve that may be tightened around the wearer's leg. Alternatively, a flexible flap may be used that projects inwardly from the interior wall of the upper. In one example, the flap or sleeve may be tightened via a drawstring or other internal tightening member that constricts the flap or sleeve around the wearer's leg. The drawstring may be flexible, or in-flexible, depending on the application. The drawstring is retained within a passageway of the sleeve or flap, such as via a sewn in tubular passage the sleeve. However, the passage may be formed in other ways.

Additionally, it will be appreciated that the eyelet configuration for the boot's drawstring may enable the drawstring to pass out of the flap or sleeve via a first set of two eyelets positioned on a top portion and toward a front region of the boot. Additionally, the drawstring may pass through the top portion of the upper via a second, different, set of two eyelets in the front half portion of the upper. Alternatively, both sets of eyelets can be at a rear portion of the boot.

The boot may also include reinforcing material that is positioned with a structure to support and stiffen the top portion of the upper to resist compression of the top portion of the upper, even during the tightening of the drawstring. In one example, the reinforcing material may include a shape retaining foam. The boot may also include an exterior layer of the top portion of the upper wraps around from an external side of the top portion to an interior layer. The exterior layer may also be coupled to the interior layer of the top portion of the upper at a seam at the top of the boot. In this configuration the interior layer may form a portion of the interior wall, and the sleeve may be coupled to the interior layer, where the sleeve is oriented in an upward direction via the drawstring relative to the sole of the boot.

In another embodiment, the flap or sleeve may be free of shape-retaining material, so that the flap can move relative to the upper to accommodate not only a tight seal against the wearer's leg, but also to permit some movement of the leg relative to the upper during walking or other movements, for example. Since the sleeve in this case is more flexible than the top portion of the upper due to the shape retaining foam support positioned within the top portion of the upper, the drawstring can be used to maintain the tight seal, but due to the two sets of eyelets, sufficient range of motion is still achieved along with maintaining the boot's appearance.

As noted herein, the arrangement described for the two pairs of eyelets, the sleeve, the upper, and the drawstring allows the sleeve to elevate and compress around a wearer's leg when the drawstring is drawn taught. In one example configuration the external eyelets are at a higher vertical elevation with respect to the boot sole as compared to a seam that couples the sleeve to the inner wall of the upper. Thus, the exterior eyelets provide an anchor point on the upper to which the more flexible sleeve is drawn during tightening of the drawstring.

Further still, the two internal eyelets may be configured to be drawn toward the two external eyelets when the drawstring is drawn taught via positioning the two internal eyelets behind the two external eyelets with respect to the front of the boot (e.g., toe region). The two internal eyelets can be guided to the two external eyelets via the drawstring since the two internal eyelets can be positioned on the sleeve such that the two internal eyelets are at a same vertical height with respect to the sole as the two external eyelets when the drawstring is drawn taught. The boot can also include an upper having layers of natural and man-made materials supported by shape retaining foam, the shape retaining foam sewn to at least a portion of the natural and man-made materials.

In still another example, the boot includes the cinching system and a tensioning device. For example, the cinching system may cover a seam between the outer upper and the inner upper. Further, the cinching system may include the sleeve or flap and the top portion of the upper configured as at least a portion of a collar that covers the seam between the outer upper and the inner upper, along with a channel between the sleeve and the collar. The valley of the channel may be oriented toward a bottom of the boot when a drawstring passing through the tubular passage is drawn taught. The tensioning device may be configured to retain the drawstring in place and may be coupled to the outer upper. The drawstring may pass out of a top of the sleeve and through a front of the upper. The boot can further comprise reinforcing shape-retaining foam positioned within the collar. In one example, the material comprising the tubular passage and the material comprising at least a portion of a collar are a same type of material such as nylon. The inner upper may be glued to the outer upper, where the collar is sewn to the outer upper, and where the material comprising a tubular passage and the material comprising at least a portion of a collar are sewn to the inner upper. The boot sole may be comprised of rubber, and the boot upper may be comprised of leather such as nubuck. Further, the sleeve can be configured to flex with a position of a drawstring. For example, a radius of the sleeve can be decreased when the drawstring is drawn taught. In addition, the top portion of the upper may be configured to flex less than the sleeve. The boot may also include a Velcro-type strap configured to tighten the boot against a foot. And, the sleeve and the top portion of the upper may each include a pair of eyelets that are brought in contact with each other when the drawstring is drawn taught.

This concludes the description. As will be appreciated by one of ordinary skill in the art, the boot described herein may be fabricated of one or more of any number of materials. Further, materials other than those described herein may be substituted without departing from the scope or breadth of the present description. Further still, the reading of this description by those skilled in the art would bring to mind many alterations and modifications without departing from the spirit and the scope of the description. For example, the features described in the present boot may be transferred to other styles of shoes or boots.

The invention claimed is:

1. A boot comprising:

a sole;

an upper coupled to the sole including a top portion having an interior wall, the top portion further having an opening for receiving a leg of a wearer;

a sleeve coupled to the interior wall of the top portion of the upper, the sleeve projecting inwardly into the opening from the interior wall of the top portion of the upper forming a flexible seal against the leg, the sleeve being more flexible than the top portion of the upper, where an exterior layer of the top portion of the upper wraps around from an external side of the top portion to an interior layer and is coupled to the interior layer of the top portion of the upper at a seam at a top portion of the boot, the interior layer forming a portion of the interior wall, and where the sleeve is coupled to the interior layer; and a drawstring, where the sleeve is oriented in an upward direction via the drawstring relative to the sole of the boot.

2. The boot of claim 1, where the interior wall defines the opening for receiving the leg of the wearer.

3. The boot of claim 1, where the drawstring is configured to reduce a circumference of the sleeve during tightening of the drawstring and to increase the circumference of the sleeve during loosening of the drawstring, without distorting the top portion of the upper.

4. The boot of claim 3, where the drawstring is retained within the sleeve via a tubular passage sewn into the sleeve.

5. The boot of claim 4, where the drawstring passes through the sleeve via a first set of two eyelets on a top portion of the sleeve.

6. The boot of claim 5, where the drawstring passes through the top portion of the upper via a second, different, set of two eyelets in a front portion of the upper, and further comprising reinforcing material configured to support the top portion of the upper, the reinforcing material stiffening the upper to resist compression of the top portion of the upper to the leg of the wearer even during the tightening of the drawstring.

7. A boot comprising:

a sole;

an upper coupled to the sole including a top portion having an interior wall, the top portion further having an opening for receiving a leg of a wearer;

a sleeve coupled to the interior wall of the top portion of the upper, the sleeve projecting inwardly into the opening from the interior wall forming a flexible seal against the leg, the sleeve being more flexible than the top portion of the upper, where the sleeve includes two internal eyelets, and where the top portion of the upper includes two external eyelets; and a shape retaining foam support positioned within the top portion of the upper.

8. The boot of claim 7, wherein the sleeve has less shape retaining foam support than the top portion of the upper, the boot further comprising a drawstring, where the sleeve includes a tubular passage configured to house the drawstring.

9. The boot of claim 7, where the drawstring passes into a first eyelet of the two external eyelets, into a first eyelet of the two internal eyelets, through the tubular passage, out of a second eyelet of the two internal eyelets, and out of a second eyelet of the two external eyelets.

10. The boot of claim 9, where the two internal eyelets are configured to be drawn toward the two external eyelets when a drawstring is drawn taught via positioning the two internal eyelets behind the two external eyelets, the two internal eyelets guided to the two external eyelets via the drawstring, the two internal eyelets positioned on the sleeve such that the two internal eyelets are at a same vertical height with respect to the sole as the two external eyelets.

11. The boot of claim 7, where the upper includes layers of natural and man-made materials supported by shape retaining foam, the shape retaining foam sewn to at least a portion of the natural and man-made materials.

12. A boot comprising:

a sole;

an outer upper;

an inner upper; and a cinching system, the cinching system covering a seam between the outer upper and the inner upper, the cinching system including a sleeve comprising a material configured as a tubular passage for a drawstring at a top portion of the cinching system, the cinching system including the top portion of the upper comprising a material configured as at least a portion of a collar that covers the seam between the outer upper and the inner upper, the cinching system including a channel between the sleeve and the collar, a valley of the channel oriented toward a bottom of the boot when a drawstring passing through the tubular passage is drawn taught.

13. The boot of claim 12, further comprising a tensioning device configured to retain the drawstring in place, the tensioning device coupled to the outer upper, and where the drawstring passes out of a top of the sleeve and through a front of the upper.

14. The boot of claim 12, further comprising reinforcing shape-retaining foam positioned within the collar.

15. The boot of claim 12, where the inner upper is glued to the outer upper, where the collar is sewn to the outer upper, and where the material comprising a tubular passage and the material comprising at least a portion of a collar are sewn to the inner upper.

16. The boot of claim 12, where the sole is comprised of rubber, where at least a portion of the outer upper is comprised of leather, where the sleeve is configured to flex with a position of a drawstring, and where the top portion of the upper is configured to flex less than the sleeve.

17. The boot of claim 12, further comprising a strap configured to tighten the boot against a foot, and where the sleeve and the top portion of the upper each include a pair of eyelets that are brought in contact when the drawstring is drawn taught.

* * * * *